United States Patent [19]

Terry

[11] Patent Number: 4,544,037

[45] Date of Patent: Oct. 1, 1985

[54] INITIATING PRODUCTION OF METHANE FROM WET COAL BEDS

[75] Inventor: Ruel C. Terry, Denver, Colo.

[73] Assignee: In Situ Technology, Inc., Golden, Colo.

[21] Appl. No.: 581,733

[22] Filed: Feb. 21, 1984

[51] Int. Cl.[4] ..... E21B 43/25

[52] U.S. Cl. ..... 166/369; 166/254; 166/311; 166/370; 299/12

[58] Field of Search ..... 166/254, 305 R, 311, 166/369; 299/2, 12, 308, 370, 371, 271

[56] References Cited

U.S. PATENT DOCUMENTS

| | | | |
|---|---|---|---|
| 2,258,616 | 10/1941 | Kendrick | 166/371 |
| 3,628,929 | 12/1971 | Glass et al. | 166/256 |
| 3,743,355 | 7/1973 | Blackwell et al. | 299/12 |
| 3,933,447 | 1/1976 | Pasini, III et al. | 166/256 |
| 3,934,649 | 1/1976 | Pasini, III et al. | 166/369 |
| 3,999,607 | 12/1976 | Pennington et al. | 166/259 |
| 4,089,374 | 5/1978 | Terry | 166/369 |
| 4,245,699 | 1/1981 | Steeman | 166/271 |
| 4,283,089 | 8/1981 | Mazza et al. | 166/308 |
| 4,305,464 | 12/1981 | Masszi | 166/370 |
| 4,471,840 | 9/1984 | Lasseter et al. | 166/308 |

OTHER PUBLICATIONS

Elder, C. H., et al., "Degasification of the Mary Lee Coalbed near Oak Grove . . . ", Report of Investigations #7968, U.S. Bureau of Mines, 1974.

*Primary Examiner*—Stephen J. Novosad
*Assistant Examiner*—Bruce M. Kisliuk
*Attorney, Agent, or Firm*—Ruel C. Terry

[57] ABSTRACT

Production of methane from an underground wet coal seam is initiated by drilling a well from the surface of the earth through the seam. Rather than pumping water to lower hydraulic head on the seam to permit desorption of methane within the coal, high pressure gas is injected into the seam to drive water away from the wellbore. Gas injection is terminated and the well is opened to flow. Initial gas production is return of injected gas, followed by a mixture of return injected gas and methane, followed by free methane from the fracture system of the coal, and then by methane desorbed from the coal. Upon return of displaced water to the wellbore, pumping operations remove water at rates that permit sustained production of desorbed methane.

7 Claims, 4 Drawing Figures

INITIATING PRODUCTION OF METHANE FROM WET COAL BEDS

FIELD OF THE INVENTION

This invention relates to production of methane from underground coal seams. More particularly the invention teaches methods of dealing with the special problems of producing methane from a coal seam that also is an aquifer. This invention extends the teachings of U.S. Pat. No. 4,089,374 of the present inventor and Ser. No. 06/486,088 filed 4/18/83 of Stoddard et al, and the prior art cited therein being herein incorporated by reference.

BACKGROUND OF THE INVENTION

It is well known in the art how coal is created over geological time, including the byproducts of the coalification process: methane, carbon dioxide, hydrogen and other gases. The volume of methane thus generated is relatively large—a ton of anthracite today occupying a volume of less that 30 cubic feet is postulated to have generated in the order of 10,000 standard cubic feet of methane during its lifetime. Some of the early methane production, no doubt, bubbled up through the waters of ancient swamps and escaped to the air above. It is well known today, however, that many underground coal seams contain a volume of trapped methane (as expressed in standard cubic feet) many times the volume of the host coal. Cores taken from underground coal, when subjected to controlled desorption tests, often yield measured methane contents that correspond to more than 600 scf per ton of coal. Thus the coal seam is both a manufacturer of methane and a reservoir for methane storage. Methane in the coal seam reservoir is same as methane found in the petroleum industry in sandstone and carbonate reservoirs.

Petroleum reservoir engineering for natural gas (composed principally of methane) production is a well established art. Coal seam reservoir engineering for methane production is an emerging art and is significantly different from the relatively straightforward engineering problems of natural gas production. Both aarts deal with production of gases trapped in underground reservoirs. When there is a substantial amount of water also present in the underground reservoir, behavior of water during production of gas must be taken into account.

In petroleum reservoir engineering a water drive downdip in a natural gas reservoir generally serves to enhance production of natural gas. A production well drilled into an updip location within the underground reservoir provides a lower pressure outlet for trapped natural gas, which flows readily to the wellhead following Darcy's Law. A routine drillstem test confirms such flow prior to the production phase.

Coal seam reservoir engineering faces more complex problems when the coal bed is an aquifer. Compared to a sandstone natural gas reservoir of the same depth, the coal seam methane reservoir tends to be relatively underpressured, and the water is located throughout the coal seam rather than being conveniently located out of the way downdip. In the sandstone natural gas reservoir porosities and permeabilities are relatively good, while the coal bed porosities and the permeabilities are relatively poor by comparison. In fact most of the methane in coal is trapped by adsorption on the enormous square footage of internal surfaces within the micropore system of the coal itself. A routing drillstream test of the coal seam, at best, will show only a small quantity of methane that flows from the fractures in the coal—but, in most cases, will show no methane at all. Thus water throughout the coal under hydraulic head pressure inhibits the two phase methane flow.

A partial reduction of hydraulic head within a gassy coal seam may permit the flow of methane from the natural fracture system, but this flow is a relatively small portion of the methane in place. This type of flow follows Darcy's Law. Adsorbed methane in the micropores, the bulk of the methane present, must be desorbed for initiation of flow, following Fick's Law of diffusion. This requires removal of all or substantially all of the hydraulic head from the vicinity of the wellbore. The two-phase steps of methane flow are desorption and flow to the fracture system (Fick's Law) and flow through the fracture system to the wellbore (Darcy's Law).

Production rates often can be increased substantially for natural gas by hydraulic fracturing of the reservoir. If the reservoir is a sandstone with low permeability, good results can be obtained by adding relatively coarse grained sand to the fracturing fluid, the sand particles serving as props to keep the fractures open. Likewise, production rates for methane drainage from coal can be increased by fracturing, but the fracturing procedures must be tailored to the special features of the coal bed. Lower rank coals are relatively soft and pliable compared to sandstone. A massive sand frac into coal may cause more problems than it solves. For example, the coal around the natural fracture system may be pulverized to the point where large amounts of coal fines accompany fluids flow to the wellbore, and a substantial amount of the frac sand may also return to the wellbore in the same manner. In the case of a high voltage content coal, fracturing pressures may cause the volatile portion of the coal to ooze into the natural fracture system, thus decreasing instead of increasing permeability as planned.

The water in a wet seam arrived in its present position by migrating through the existing fracture system of the coal. Since this water must be substantially removed for effective methane production, a great deal of useful data can be gained from the water itself. If the water is potable, its source is probably from a distant outcrop of the coal—useful information when compared with information related to pumping rates needed to remove hydraulic head. This newly acquired data may indicate that the existing fracture system required little or no further stimulation. If the water contains a considerable amount of dissolved solids, its source probably is from remnants of an ancient ocean, which if nearby certainly should not be further connected by additional fracturing.

Looking again to the differences between natural gas reservoir production and coal bed methane production, a natural gas well typically is drilled through the carbonate or sandstone rock reservoir. A drillstream test is made to confirm that gas is present. Then well logs are run and casing is set to a location at or below the bottom of the reservoir. From well logs optimum locations for perforations are selected and the casing is perforated. With a water drive downdip, the well will clean up in a relatively short time with maximum production rate attained, followed by gradual reduction of production rates over an extended period of time measured in years. A similar well for coal bed methane production would be drilled through the coal seam and into the underlying stratum. Preferably the well would be cored from a point above the coal seam, through the seam and to a point below the seam. Cores of the coal would be subjected to controlled desorption tests to ascertain methane content. Casing would be set, preferably to the top of the seam for a "barefoot" completion with open hole through the coal. A pump then would be set, preferably below the coal to avoid ascending gas bubbles that would vaporlock the pump. Upon opening the well, water would rise in the wellbore until static head level is attained—a point that could be 100 feet or so below the wellhead. Well logs could be run at an appropriate time during the drilling sequence for accurate determination of coal seam location, but there are no well logs available currently that can detect the presence or absence of methane in the coal. With the well open at the wellhead and the column of water at the static head level, typically no methane is produced, so there is no well cleanup at this point and no indication of what the production rate curve may be. To attain well cleanup, methane production and an indication of the true form of the production rate curve, hydraulic head must be reduced in the vicinity of the wellbore.

At the present state of the art for coal bed methane reservoir engineering, hydraulic head is removed by the simple expedient of extensive pumping operations. Water lifting operations may involve production of 200 or more barrels per day for a year or more before well cleanup begins. During well cleanup typically the first methane is produced as a flow from the fracture system. This methane flow generally is of short duration, a matter of days, fitfully initially, followed by a relatively strong blow, then a relatively sharp decline. Water pumping must continue to maintain water drawdown that permits continuing cleanup of the micropore system adjacent to the coal fracture system. This initiates desorption of methane from the micropores and begins the sustained production to be expected from the well. Complete well cleanup requires an extended period of time, compared to the relatively short period required for a natural gas well. Consequently, the production rate curves are quite different for these two types of wells.

The production rate curve for the natural gas well, after faltering somewhat during a brief well cleanup period, rapidly reaches a peak production rate that may remain relatively flat for a period of time, followed by a gradual decline over a long period of time. Typically there is no water production until near the end of commercial production.

The production rate curve for the wet coal bed methane well shows a brief burst of production (free methane in the fracture system) followed by a lull in production, followed by sustained production at a low rate, with ever increasing production rates to a peak rate many years later. Initially, water production rates are relatively high and then decline as methane production rates increase. It is postulated that once a coal bed methane well reaches peak production rate, a decline will set in, comparable to that of a natural gas well; however, no wells so far have been in production long enough to verify this projection. Likewise, it is postulated that coal bed water production will decline to zero, or near zero, at some point in time, long before the methane well reaches economic depletion.

A new discovery of natural gas can be confirmed immediately upon completion of a drillstem test. Determination of the true economic significance, however, must await production performance over a period of time to determine the projected volume of the reservoir and the projected rates of recovery. A new discovery of wet coal bed methane can be confirmed upon completion of desorption tests on cores. Determination of its economic significance, likewise, must await future events. The coal bed reservoir engineer would, as a minimum, like to see production rate curves for the initial temporary production, the beginning of sustained production, and more particularly the slope of the sustained production rate curve—sometimes called the "reverse decline" curve. From an economic point of view, it would be advantageous to see these segments of the curves before a lengthy and costly water pumping operation is undertaken.

It is an object of the present invention to teach methods of dewatering a coal seam within the vicinity of the wellbore, without resorting to conventional pumping, in order to establish early production and the resulting data therefrom. Other objects and advantages of the invention will become apparent as the description proceeds.

SUMMARY OF THE INVENTION

A well is drilled from the ground surface through the overburden and into an underground gassy coal seam that also is an aquifer. Water in the seam is driven away from the wellbore by injection of a gas into the coal. Gas injection is terminated, the well is opened, and gas flow is established into the wellbore. Initially the flow is returning injected gas, followed by methane for a period of time, then eventually by return of water. Prior to return of water, methane production rate data are established both for free methane flow and for desorbed methane flow.

DESCRIPTION OF THE PREFERRED EMBODIMENTS

Coal deposits ideal to the practice of the invention are located in the various coal provinces of the United States and elsewhere. Generally it is preferred that the seam contain at least 50 scf of methane per ton of coal, that the seam also is an aquifer, that the seam have a moderate dip and that the source of water in the seam is in a remote area away from the planned methane production area.

Figure 1:
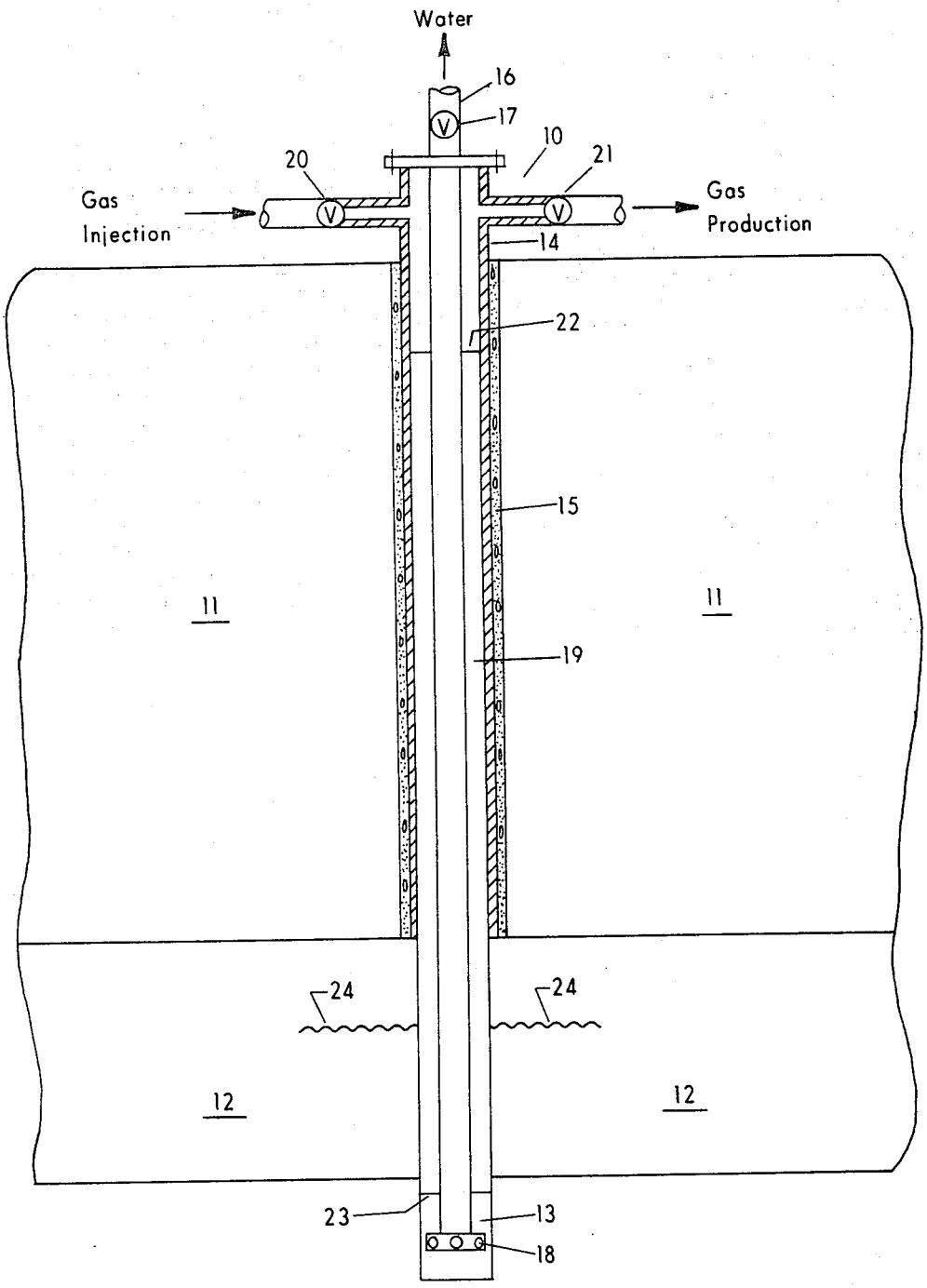
FIG. 1 is a diagrammatic vertical section taken through a portion of the earth showing a well equipped for the methods of the invention. The well penetrates the overburden, the coal seam and into the underburden.

Referring now to FIG. 1, a production well 10 is drilled from the surface of the earth, through overburden 11, through coal seam 12 and into the underburden, forming sump 13. During drilling of well 10 it is preferred that cores be taken from a point above coal seam 12, through coal seam 12 and to a point below coal seam 12. Cores of the coal are preferably subjected to methane desorption tests to ascertain the methane content present in the coal seam. Preferably conventional well logs are run to determine if there are aquifers overlying the coal and to locate accurately the coal seam, including any breaks in the seam such as thin sections of shale. If hydraulic fracturing is planned, it is preferred to bottom the drillhole a distance below the coal seam, for example 200 feet below the seam, so that well logs can determine the presence of aquifers, if any, underlying the coal seam.

After the borehole is completed, casing 14 is set and cemented 15 into place, preferably from the ground surface to to the top of coal 12. A pump 18 is positioned, preferably in sump 13, with water production tubing 16 connecting pump 18 with surface facilities (not shown). Suitable wellhead fittings are affixed to casing 14 to complete the hermetic seal of well 10.

Coal seam 12 is an aquifer, and upon opening valve 21 water will rise in annulus 19 to its static head level, for example to level 22. While some methane in coal seam 12 may be produced upon opening valve 21, typically the amount will be small and often will be zero.

Figure 2:
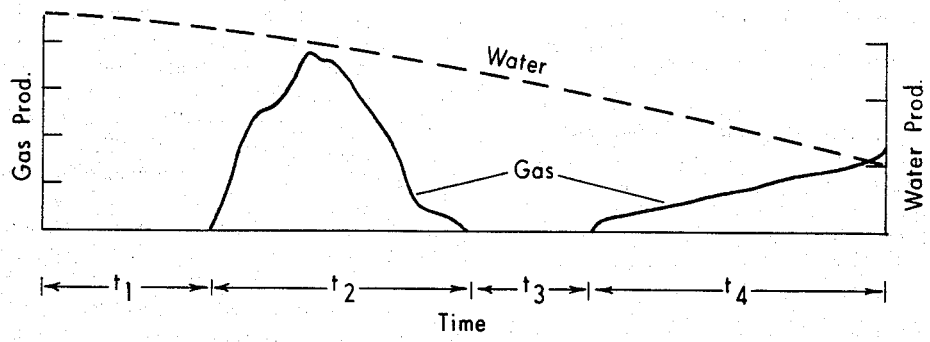
FIG. 2 is a graph showing water and gas production over time spans when hydraulic head is controlled by pumping.

A review of prior art methods is considered instructive in the understanding of the present invention. Coal seam 12 is an aquifer and the amount of methane in the seam is known from desorption tests on the cores. Prior art procedures begin with actuating pump 18 and undertaking a lengthy water withdrawal program to lower hydraulic head as illustrated in FIG. 2. Water pumping continues for a period of time $t_1$, for example several months to a year or more, at which time the hydraulic head is lowered to the extent necessary to permit flow of the methane located in the coal fracture system near the wellbore. Water production continues during time $t_2$, for example a matter of days or weeks, methane production increases to a peak value and then declines relatively rapidly as the volume of free methane in the affected fracture system is depleted.

Water withdrawal continues for time $t_3$, for example a period of days, while adsorbed methane is desorbing from the micropores of the coal and begins to flow into the fracture system connected to well 10. Water withdrawal continues for time $t_4$, for example a matter of weeks, and desorbed methane volume begin increasing, following the so called "reverse decline curve". Beyond that shown in FIG. 2, the negative decline production curve continues ascending for an extended period of time, for example say 30 years, depending upon well spacing of competing wells.

The typical procedures of the prior art, described in the foregoing paragraphs, involve costly water withdrawals over lengthy periods of time before the reservoir engineer has an opportunity to gather data to plot the beginning of the negative decline production curve. The slope of this curve is a useful tool in forecasting the economic success or failure of the well.

Looking now to the methods of the present invention, water withdrawal is postponed until after data are collected that indicate the slope of the "reverse decline" curve. Production well 10 is drilled cored, logged and equipped as previously described and illustrated in FIG. 1. Rather than open valve 21 to permit water to rise to the static head level, valve 21 remains closed.

It is well known in the art that water and other liquids in an underground formation can be driven away from a wellbore by injecting a gas into the formation, such gas being injected at a pressure exceeding the hydraulic head pressure of liquids in the formation. The areal extent of the displacement of liquids can be quite large, with radii measured from the wellbore in the order of hundreds to thousands of feet.

In the method of the present invention, valve 20 is opened with all other valves closed. A suitable gas is injected through valve 20 into coal 12 at a pressure exceeding hydraulic head pressure of the water in coal 12 but less than the fracturing pressure of coal 12, for example in the range of 0.433 psi per foot of vertical depth to the coal seam and less than 1.25 psi per foot of vertical depth.

If the coal is a shrinking coal, the preferred injection gases are air, oxygen enriched air or oxygen. The injected gas thus serves a two-fold purpose: displacement of water and the partial oxydation of coal 12. Oxidation causes the reactive coal to shrink and thereby become more permeable to flow of gases, facilitating desorption and flow of methane when the injection is stopped and well 10 is opened. If coal 12 is a swelling coal, preferred injection gases are any convenient gas that is inert to coal, such as nitrogen and carbon dioxide.

Figure 3:
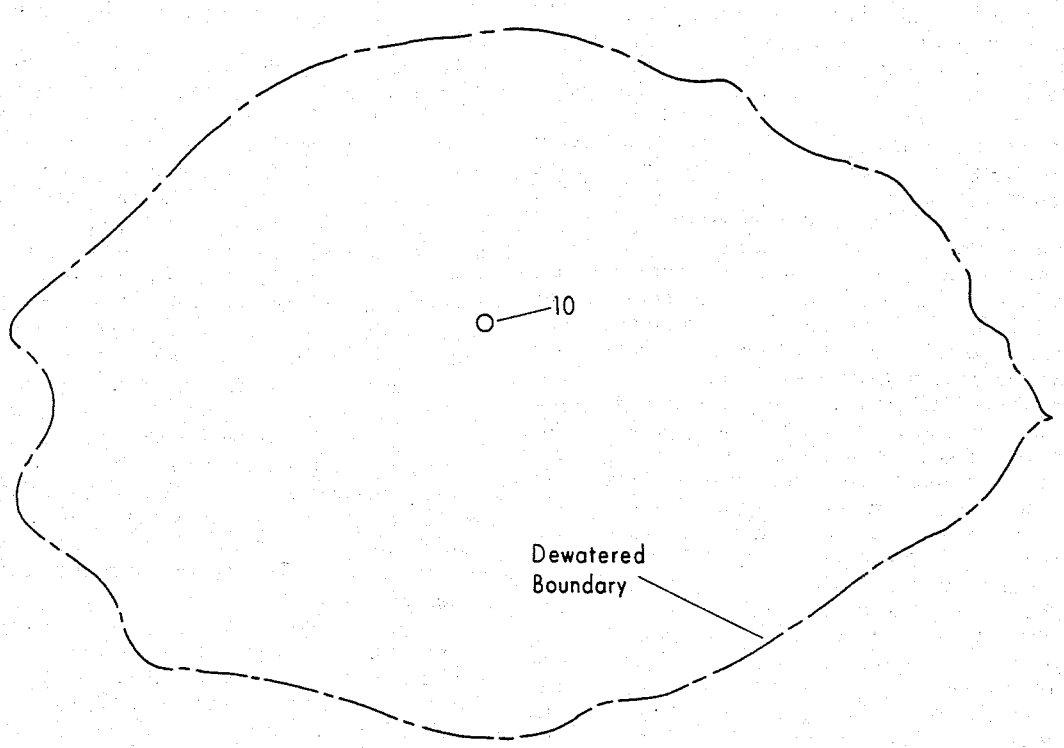
FIG. 3 is a plan view showing the dewatered area around a production well using the methods of the invention.
Figure 4:
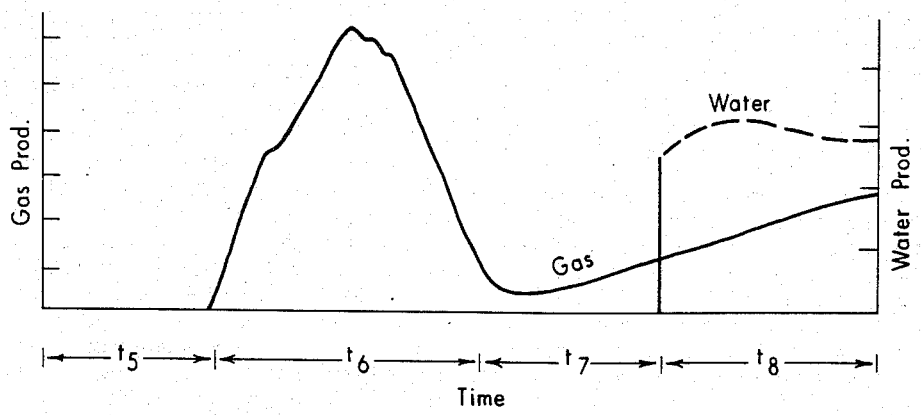
FIG. 4 is a graph showing water and gas production over time spans when water is controlled using methods of the invention.

Injection of a suitable gas continues through valve 20 (see FIG. 3) until the dewatered boundary is sufficiently removed from well 10 to permit testing as illustrated by FIG. 4. Injection is terminated and valve 20 is closed for a period of time $t_5$, for example 24 hours or more to permit both formation pressure and the dewatered boundary to stabilize. Valve 21 is then opened for time $t_6$, for example a matter of hours or days for a shrinking coal and generally a longer period for a swelling coal. During time $t_6$, gas production through valve 21 initially will be return of injected gas, followed by a mixture of return injected gas and methane, and finally by methane from the system of fractures. With valve 21 open, methane continues to be produced for time $t_7$, such methane being principally that of methane initially desorbed from the micropore system of coal 12 as indicated by the beginning of the reverse decline curve.

At the end of time $t_7$, displaced water has returned to the wellbore with the flow of methane. Valve 21 remains open, valve 17 is opened and pump 18 is activated to remove oncoming water for time $t_8$. Time $t_8$ can be extended, for example a matter of years, as gas production increases and water production wanes.

In some cases there may be an unforeseen fracture pattern in coal 12 that permits premature return of water to the well during times $t_6$ and $t_7$. In such cases it is desirable to reestablish gas injection to extend the dewatered boundary into less permeable areas of coal 12, then proceed with methane production as previously described.

In some cases, particularly when coal 12 is a relatively thick seam subject to caving into the wellbore, it is desirable to set casing 14 from the surface of the earth through coal 12. In those cases access to the coal is attained by perforating casing 14 adjacent to coal 12, using procedures common in the petroleum industry.

In an alternate embodiment of the present invention, prior to installation of pump 18 and prior to removal of water from the vicinity of well 10, the coal seam is stimulated to increase permeability significantly in the immediate area around well 10. This stimulation can be accomplished in the open hole when casing is set to the top of coal 12, or through perforations when casing is set through coal 12. Such stimulation is done at pressures necessary to breakdown coal 12 to create enhanced permeability patterns 24 as shown in FIG. 1.

Stimulation is accomplished using procedures common in the petroleum industry wherein selected fluids are injected into the pay zone, in this case coal 12. Suitable injection fluids are selected with due regard to the type of coal present, and include fluids containing oxygen, fluids without freely combining oxygen, water, thickened water, proppant laden water, acids, diluted acids and the like.

When the coal 12 is a reactive coal, that is, a coal that shrinks when subjected to oxygen, stimulation of the coal seam to enhance permeability can be accomplished at pressures greater than hydrostatic head pressure but less than the pressure needed to breakdown the coal. In this case the preferred injection fluid is an oxygen-carrying gas such as air, oxygen enriched air or oxygen.

Thus it may be seen that standard petroleum industry methods of producing natural gas from porous and permeable rock strata must be modified considerably when the pay zone is coal containing occluded or adsorbed methane.

While the present invention has been described with a certain degree of particularity, it is understood that the present disclosure has been made by way of example and that changes in detail of structure may be made without departing from the spirit thereof. It will be appreciated that this invention is not limited to any theory of operation, but that any theory that has been advanced is merely to facilitate disclosure of the invention.

What is claimed is:

1. A method of producing methane from a gassy underground coal seam that also is an aquifer, wherein the aquifer contains hydraulic head that impedes free flow of methane from the fracture system within the coal and free flow of the methane contained within the pore system of the coal, comprising the steps of:

drilling a well from the surface of the earth into the underground coal, the well being cased with casing cemented in place, and the well having means to permit injection of fluids into the underground coal, means to withdraw fluids from the underground coal, and means to terminate injection of fluids into and withdrawal of fluids from the underground coal, injecting a gas into the well and into the coal under sufficient pressure to displace water from the coal within the vicinity of the wellbore, terminating injection of the gas, then opening the well to the flow of fluids and producing first the injected gas, followed by producing a mixture of the injected gas and methane, and then by producing methane.

2. The method of claim 1 wherein the underground coal is a shrinking coal and the injected gas is selected from the group comprising air, oxygen-enriched air and oxygen.

3. The method of claim 1 further including the step of establishing a fracture radially outward from the wellbore through the coal.

4. The method of claim 1 further including the steps of taking cores from the underground coal, then subjecting the cores to desorption tests to ascertain methane content.

5. The method of claim 1 wherein the well is drilled through the underground coal and into the underburden and wherein a pump is placed in that portion of the well drilled into the underburden.

6. A method of producing methane from an underground gassy coal seem that is also an aquifer, comprising the steps of establishing a means of communication between the surface of the earth and the underground coal seam, injecting a gas into the means of communication and into the underground coal, with the resultant displacement of water in the coal from the means of communication, terminating injection of the gas, then producing fluids from the coal through the means of communication, wherein the first produced fluid is the injected gas, followed by producing a mixture of the injected gas and methane, and then by producing methane, and wherein the coal is a swelling coal and the injected gas is inert to coal.

7. A method of producing methane from an underground coal seam that is an aquifer, comprising the steps of establishing a means of communication between the surface of the earth and the underground coal seam, injecting a gas into the means of communication and into the underground coal, with the resultant displacement of water in the coal away from the means of communication, terminating injection of the gas, then producing fluids from the coal through the means of communication, wherein the first produced fluid is the injected gas, followed by producing a mixture of the injected gas and methane, then producing methane, positioning a pump in the means of communication, and pumping to the surface of the earth the formation water flowing into the means of communication.

* * * * *